US011214971B1

(12) United States Patent
MacKarvich

(10) Patent No.: US 11,214,971 B1
(45) Date of Patent: Jan. 4, 2022

(54) BASE FOR GUARDRAIL SYSTEM

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 0 days.

(21) Appl. No.: 17/097,927

(22) Filed: Nov. 13, 2020

(51) Int. Cl.
*E04G 21/32* (2006.01)

(52) U.S. Cl.
CPC ..... *E04G 21/3242* (2013.01); *E04G 21/3214* (2013.01)

(58) Field of Classification Search
None
See application file for complete search history.

(56) References Cited

U.S. PATENT DOCUMENTS

| | | | | |
|---|---|---|---|---|
| 716,077 | A | 12/1902 | Morrin | |
| 1,030,383 | A | 6/1912 | Buschman | |
| 1,132,658 | A | 3/1915 | Harrison | |
| 1,477,685 | A | 12/1923 | Bostwick | |
| 1,760,955 | A | 6/1930 | Moss | |
| 1,775,558 | A | 9/1930 | Jayne | |
| 2,641,513 | A | 6/1953 | Fryda | |
| 3,020,023 | A * | 2/1962 | MacIntyre | E01F 9/692 256/24 |
| 3,150,891 | A | 9/1964 | Kirkeby | |
| 3,204,898 | A | 9/1965 | Manning | |
| 3,285,576 | A | 11/1966 | Clark | |
| 4,037,788 | A | 7/1977 | Riley | |
| 5,328,287 | A | 7/1994 | Gilb | |
| 5,372,447 | A | 12/1994 | Chung | |
| D388,193 | S | 12/1997 | Villaescusa | |
| D389,252 | S | 1/1998 | Alberson | |
| 6,554,257 | B1 * | 4/2003 | Kenton | E04G 21/3233 256/24 |
| D520,649 | S | 5/2006 | Hansort | |
| D521,159 | S | 5/2006 | Hansort | |
| 7,232,098 | B2 | 6/2007 | Rawlings et al. | |
| RE39,842 | E | 9/2007 | Purvis et al. | |
| D554,474 | S | 11/2007 | Miller | |
| D556,015 | S | 11/2007 | Muchnik | |
| 7,338,033 | B2 | 3/2008 | Anson et al. | |
| D599,915 | S | 9/2009 | Godwin | |
| 7,631,409 | B2 | 12/2009 | Dehlsen | |
| 8,014,168 | B2 * | 9/2011 | Lanning | H01R 25/145 361/807 |

(Continued)

FOREIGN PATENT DOCUMENTS

| | | |
|---|---|---|
| EP | 1300518 | 4/2003 |
| WO | 2008037023 | 4/2008 |

OTHER PUBLICATIONS

MacKarvich, Charles J.; Applicant-Initiated Interview Summary for U.S. Patent and U.S. Appl. No. 15/901,407, filed Feb. 21, 2018, dated Sep. 2, 2020, 9 pgs.

(Continued)

*Primary Examiner* — Steven M Marsh
(74) *Attorney, Agent, or Firm* — Taylor English Duma LLP

(57) ABSTRACT

A guardrail base can include, in some aspects, a base body including a first foot, a second foot separate from and distal from the first foot, and a raised portion between the first foot and the second foot; and a rail mount including a fixed clamp body secured to the base body and a floating clamp body offset from and coupled to the fixed clamp body.

21 Claims, 10 Drawing Sheets

(56) References Cited

U.S. PATENT DOCUMENTS

| | | | | |
|---|---|---|---|---|
| 8,925,904 | B2 | 1/2015 | Christoffer et al. | |
| D732,374 | S | 6/2015 | Herbertsson | |
| D732,932 | S | 6/2015 | Ng et al. | |
| 9,115,506 | B2 * | 8/2015 | Hill | E04H 17/1417 |
| D752,954 | S | 4/2016 | Lax et al. | |
| D757,520 | S | 5/2016 | Pratt | |
| D758,609 | S | 6/2016 | Schindler et al. | |
| 9,376,832 | B2 | 6/2016 | Deering | |
| D767,167 | S | 9/2016 | Masuda et al. | |
| 9,863,162 | B2 | 1/2018 | Whiteley | |
| D810,965 | S | 2/2018 | Whiteley | |
| D813,647 | S | 3/2018 | Burmeister-Brown et al. | |
| D822,650 | S | 7/2018 | Kanter | |
| D823,286 | S | 7/2018 | Kanter | |
| D823,093 | S | 10/2018 | Kanter | |
| D830,812 | S | 10/2018 | Kanter | |
| D831,860 | S | 10/2018 | MacKarvich | |
| D833,851 | S | 11/2018 | Kanter | |
| 10,180,011 | B2 | 1/2019 | White | |
| 10,214,935 | B2 | 2/2019 | Whiteley | |
| 10,294,674 | B2 | 5/2019 | Guo | |
| 10,428,552 | B2 | 10/2019 | Sinclair | |
| D882,830 | S * | 4/2020 | MacKarvich | D25/133 |
| 10,900,236 | B2 * | 1/2021 | Winter | E04F 11/1834 |
| 10,954,691 | B2 | 3/2021 | MacKarvich | |
| D932,660 | S | 10/2021 | Mackarvich | |
| 2005/0056741 | A1 | 3/2005 | Higgs et al. | |
| 2006/0175594 | A1 * | 8/2006 | Burkart | E04F 11/1817 256/65.02 |
| 2011/0017968 | A1 * | 1/2011 | Christoffer | E01F 13/022 256/65.14 |
| 2013/0082227 | A1 * | 4/2013 | Budenbender | E04G 21/3242 256/65.14 |
| 2014/0231739 | A1 * | 8/2014 | Marron | E04H 17/1417 256/65.04 |
| 2015/0041744 | A1 | 2/2015 | Higgs | |
| 2017/0152674 | A1 | 6/2017 | MacKarvich | |
| 2017/0363124 | A1 | 12/2017 | Brown | |
| 2018/0155939 | A1 | 6/2018 | Aldridge | |
| 2019/0257112 | A1 | 8/2019 | MacKarvich | |

OTHER PUBLICATIONS

MacKarvich, Charles J.; Applicant-Initiated Interview Summary for U.S. Appl. No. 15/901,407, filed Feb. 21, 2018, dated Nov. 23, 2020, 6 pgs.

MacKarvich, Charles J.; Final Office Action for U.S. Appl. No. 15/901,407, filed Feb. 21, 2018, dated Oct. 1, 2020, 15 pgs.

MacKarvich, Charles J.; Non-Final Office Action for U.S. Appl. No. 15/901,407, filed Feb. 21, 2018, dated Jun. 18, 2020, 35 pgs.

MacKarvich, Charles J.; Notice of Allowance for U.S. Appl. No. 15/901,407, filed Feb. 21, 2018, mailed Dec. 10, 2020, 12 pgs.

MacKarvich, Charles J.; Issue Notification for Design U.S. Appl. No. 29/616,098, filed Sep. 1, 2017, dated Oct. 3, 2018, 1 pg.

MacKarvich, Charles J.; Notice of Allowance for U.S. Appl. No. 29/616,098, filed Sep. 1, 2017, dated Jun. 28, 2018, 12 pgs.

MacKarvich, Charles J.; Ex Parte Quayle Action for U.S. Appl. No. 29/663,351, filed Sep. 14, 2018, mailed Oct. 1, 2019, 15 pgs.

MacKarvich, Charles J.; Notice of Allowance for U.S. Appl. No. 29/663,351, filed Sep. 14, 2018, dated Dec. 27, 2019, 9 pgs.

MacKarvich, Charles J.; Corrected Notice of Allowance for U.S. Appl. No. 15/901,407, filed Feb. 21, 2018, dated Feb. 22, 2021, 8 pgs.

Mackarvich, Charles J.; Notice of Allowance for Design U.S. Appl. No. 29/783,040, filed May 11, 2021, dated Aug. 30, 2021, 18 pgs.

* cited by examiner

BASE FOR GUARDRAIL SYSTEM

TECHNICAL FIELD

Field of Use

This disclosure relates to guardrail systems. More specifically, this disclosure relates to guardrail systems comprising a guardrail base with a rail mount for securely fixing a position of a guardrail and a base extension for further fixing a position of the guardrail base.

Related Art

A guardrail system can help maintain workers and materials within a safe work area, including when the work area is elevated such as on a surface of a roof of a building. If an object or a person falls on, leans against, pushes, or otherwise contacts the guardrail from within the work area, a force resulting from that contact can in some cases be enough to cause rotation of the guardrail sufficient to allow the object or person to trespass the guardrail system, especially when the guardrail system is not positively secured to the aforementioned surface with fasteners. Furthermore, it can be helpful for guardrail posts to be easily inserted and yet also positively secured in guardrail bases.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a guardrail base comprising: a base body comprising a first foot, a second foot separate from and distal from the first foot, and a raised portion between the first foot and the second foot; and a rail mount comprising a fixed clamp body secured to the base body and a floating clamp body offset from and coupled to the fixed clamp body.

In a further aspect, disclosed is a guardrail system comprising: a guardrail base defining an effective support length; and a base extension lockably engaged with the guardrail base and extending the effective support length, any rotation of the guardrail base resulting in lifting and rotation of the base extension, a lower surface of the base extension facing an upper surface of the guardrail base.

In yet another aspect, disclosed is a method for installing a guardrail system, the method comprising: placing a guardrail base on a surface, the guardrail base comprising: a base body; and a rail mount comprising a fixed clamp body secured to the base body and a floating clamp body coupled to the fixed clamp body; inserting a post of a guardrail into a post bore defined by the rail mount of the guardrail base; and tightening the rail mount about the post to positively fix an angle of the post with respect to the guardrail base.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 2:
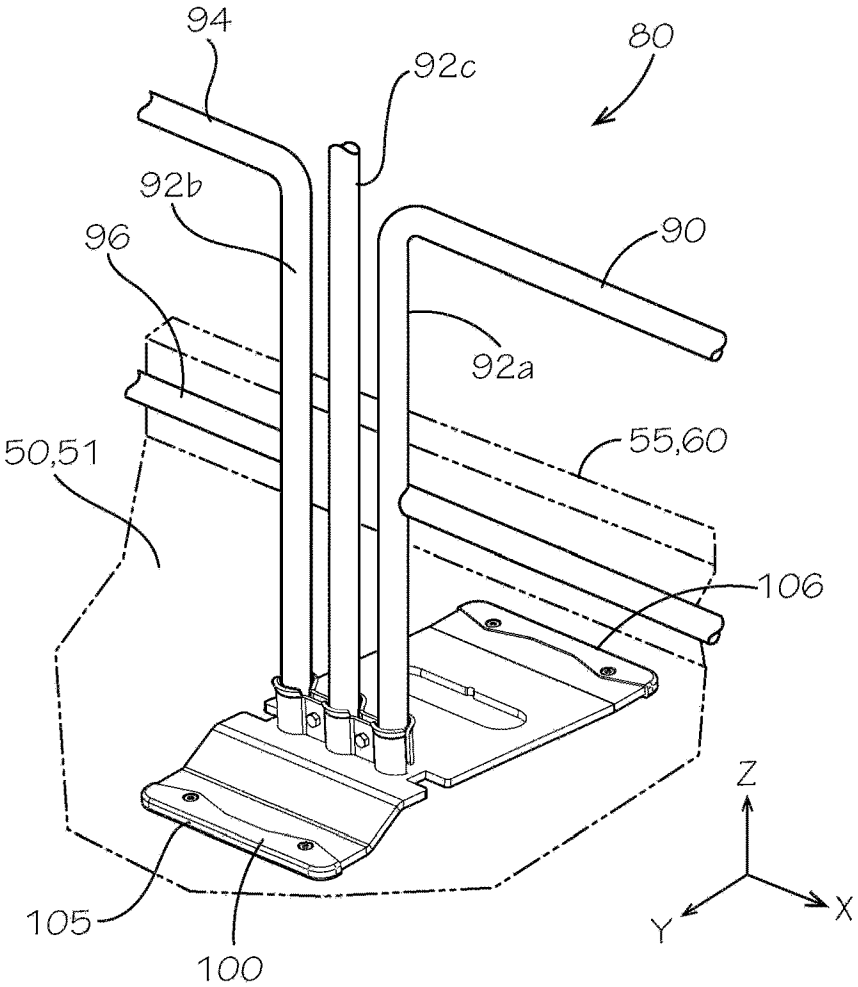
FIG. 2 is a perspective view of the guardrail system of FIG. 1 showing a single guardrail base and a portion of a guardrail.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of a guardrail system 80 (shown in FIG. 1) or other disclosed structure that is nearest to an individual facing an inside of the system and opposite from a danger (e.g., an edge of an elevated structure) against which the system seeks to protect; "rear" is that end of the system that is opposite or distal the front; "left" is that which is to the left of or facing left from an individual facing towards the front; and "right" is that which is to the right of or facing right from that same individual while still facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

The guardrail system 80 or other disclosed structure can also be described on the basis of a coordinate axis of X-Y-Z directions shown in one or more of the figures. An X-axis direction can be referred to as a left-right or horizontal direction. For example, as shown in FIG. 2, the X-axis direction can coincides with an extension direction of a guardrail 90 (shown in FIG. 1) of the guardrail system 80.

Figure 1:
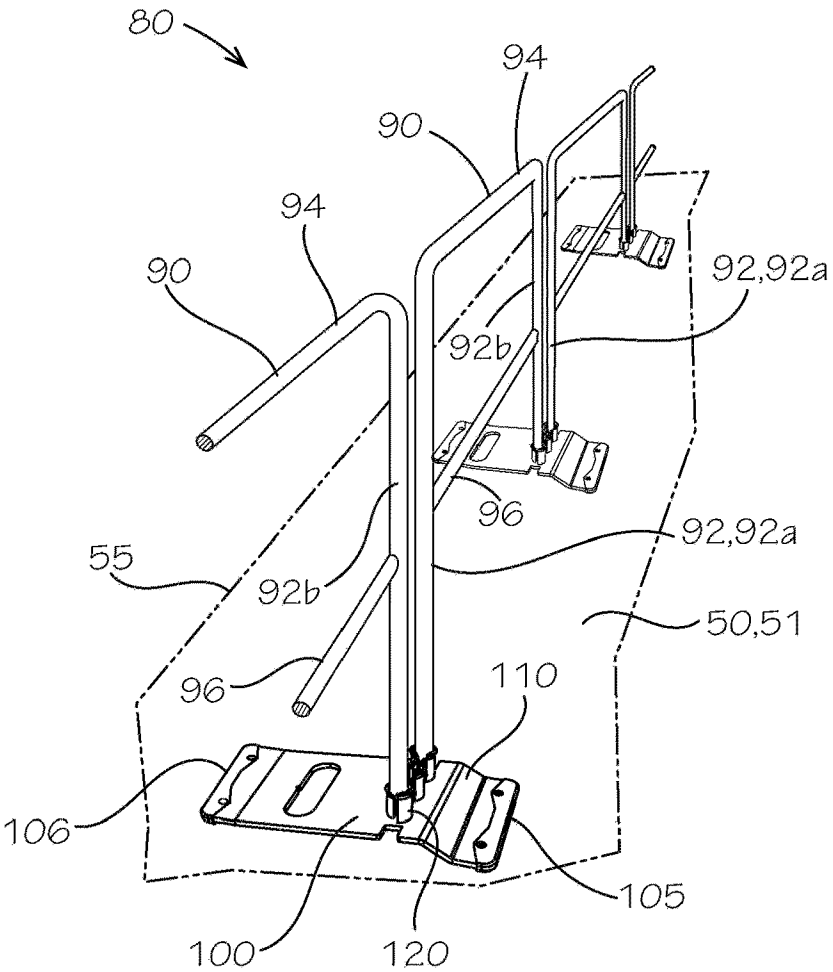
FIG. 1 is a perspective view of a guardrail system positioned on an elevated surface of a structure in accordance with one aspect of the current disclosure.

A Y-axis direction is orthogonal to the X-axis direction (left-right direction) and a Z-axis direction (upper-lower direction) and can also be referred to as a front-rear direction or a transverse direction or a length direction of a guardrail base 100 (shown in FIG. 1) from a first end 105 (shown in FIG. 1) to a second side end 106 (shown in FIG. 1). A surface of a structural element that is parallel with the front-rear direction can be referred to as a lateral side.

An upper-lower direction is the Z-axis direction, which is orthogonal to the X-axis direction and to the Y-axis direction and typically coincides with a height of the guardrail system 80. For example, a direction along which a post 92 (shown in FIG. 1) of the guardrail 90 can be inserted into a rail mount 120 (shown in FIG. 1) of the guardrail base 100 and locked into the guardrail base 100 can be referred to as the Z-axis direction. Also, the upper-lower direction can coincide with a direction perpendicular to a surface of a surface 51 (shown in FIG. 1) of a structure 50 (shown in FIG. 1) on which the system 80 can be placed.

In one aspect, a guardrail system and associated methods, systems, devices, and various apparatuses are disclosed herein. In some aspects, the guardrail system can comprise a guardrail base. In some aspects, the guardrail system can comprise a base extension.

FIGS. 1 and 2 are perspective views of the guardrail system 80 positioned on the surface 51 of the structure 50 in accordance with one aspect of the current disclosure. The guardrail system 80 can comprise the guardrail base 100 and the guardrail 90. In some aspects, as shown, the surface 51 can be an elevated surface extending to and defining an edge 55 of, for example and without limitation, a roof of the structure 50. In some aspects, the surface 51 need not be elevated but the guardrail system 80 can nonetheless be a barrier to prevent, limit, or restrict access to a portion of the surface 51 sufficiently proximate to a hazard and beyond the edge 55. In some aspects, the surface 51 can be horizontal in orientation. In some aspects, the surface 51 can be angled or sloped with respect to the horizontal. In some aspects, as shown in FIG. 2, a parapet 60 can define the edge 55.

Referring to FIG. 1, if an object or a person falls, leans, pushes, or otherwise contacts the guardrail 90 from within a work area opposite from the edge 55 (i.e., "inside" the guardrail 90), a force resulting from that contact can be transferred from the point of contact on the guardrail 90 to the rail mount 120, from the rail mount 120 to a base body 110 of the guardrail base 100, and then from the base body 110 to the surface 51 of the structure 50. Based on various factors such as, for example and without limitation, a horizontal distance between the ends 105,106 of the base body 110 of the guardrail base 100, a horizontal distance between the point of application of the force and the second end 106, a vertical distance between the point of application of the force and the second end 106, a weight and a center of gravity of not only the guardrail 90 and the guardrail base 100, and, as shown, connections with neighboring portions of the guardrail system 80, the aforementioned force can effectively be withstood without rotation of the guardrail 90 (e.g., about the X-axis direction shown in FIG. 2 and towards the Z-axis direction shown in FIG. 2) sufficient to allow the object or person to trespass the guardrail system 80. More specifically, a center of gravity of the guardrail system 80 can be positioned between the first end 105 and the second end 106 of the base body 110. Based on various factors such as, for example and without limitation, the surface area of feet 305,306 (shown in FIG. 3) and a coefficient of friction of an interface between the feet 305,306 and the surface 51 at the ends 105,106 of the guardrail base 100, the aforementioned force can also effectively be withstood without translation of the guardrail 90 (e.g., in the negative Y-axis direction shown in FIG. 2) sufficient to allow the object or person to trespass the guardrail system 80.

In some aspects, the guardrail base 100 need not be secured to the structure 50 with fasteners to withstand the aforementioned force, the guardrail base 100 and any other portions of the guardrail system 80 can be easily set up on, adjusted about, and broken down as desired from the structure 50 without penetrating the surface 51 of the structure 50. More specifically, as shown, the guardrail base 100 can be configured to be placed on the surface 51 without fasteners attaching it to the surface 51. Penetration of the surface 51 by, for example, the forming of holes in the surface 51, can be undesirable. As shown, the guardrail base 100 need not reach, much less contact, the edge 55 of the structure 50 to be effective.

The guardrail system 80 can comprise the aforementioned guardrail base 100 and the guardrail 90, which can be received within and secured by the guardrail base 100. The guardrail 90 can comprise the posts 92 (also shown as posts 92*a,b,c*, with post 92*c* shown in FIG. 2), which can be oriented vertically or otherwise angled with respect to the guardrail base 100 and with respect to the surface 51. As shown, the guardrail 90 can take any one of several forms including that of a stationary guardrail 90. In some aspects, the guardrail 90 can comprise a gate configured to rotate or can comprise a single post 92. In some aspects, as shown, the guardrail 90 can comprise at least one post 92*a,b* on each end. In any case, each of the posts 92*a,b,c* can be received within a post bore 380*a,b,c* (shown in FIG. 3) defined within the rail mount 120 of the guardrail base 100.

The guardrail 90 can comprise cross posts such as upper cross posts 94 and lower cross posts 96. Each of the cross posts 94,96 can extend from the posts 92*a,b* of each guardrail 90. The cross posts 94,96 can be oriented horizontally or otherwise angled with respect to the posts 92*a,b* and with respect to a vertical orientation. In some aspects, a third post 92*c* (shown in FIG. 2) or additional posts not shown can extend from the guardrail base 100 and form part of the guardrail system 80. The post 92*c*, only a portion of which is shown, can, for example and without limitation, facilitate the creation of or define a portion of an additional run or line of guardrails 90, which can be angled with respect to the initial run or line of guardrails 90 shown, to protect against an additional hazard not fully protected by the initial run.

Figure 3:
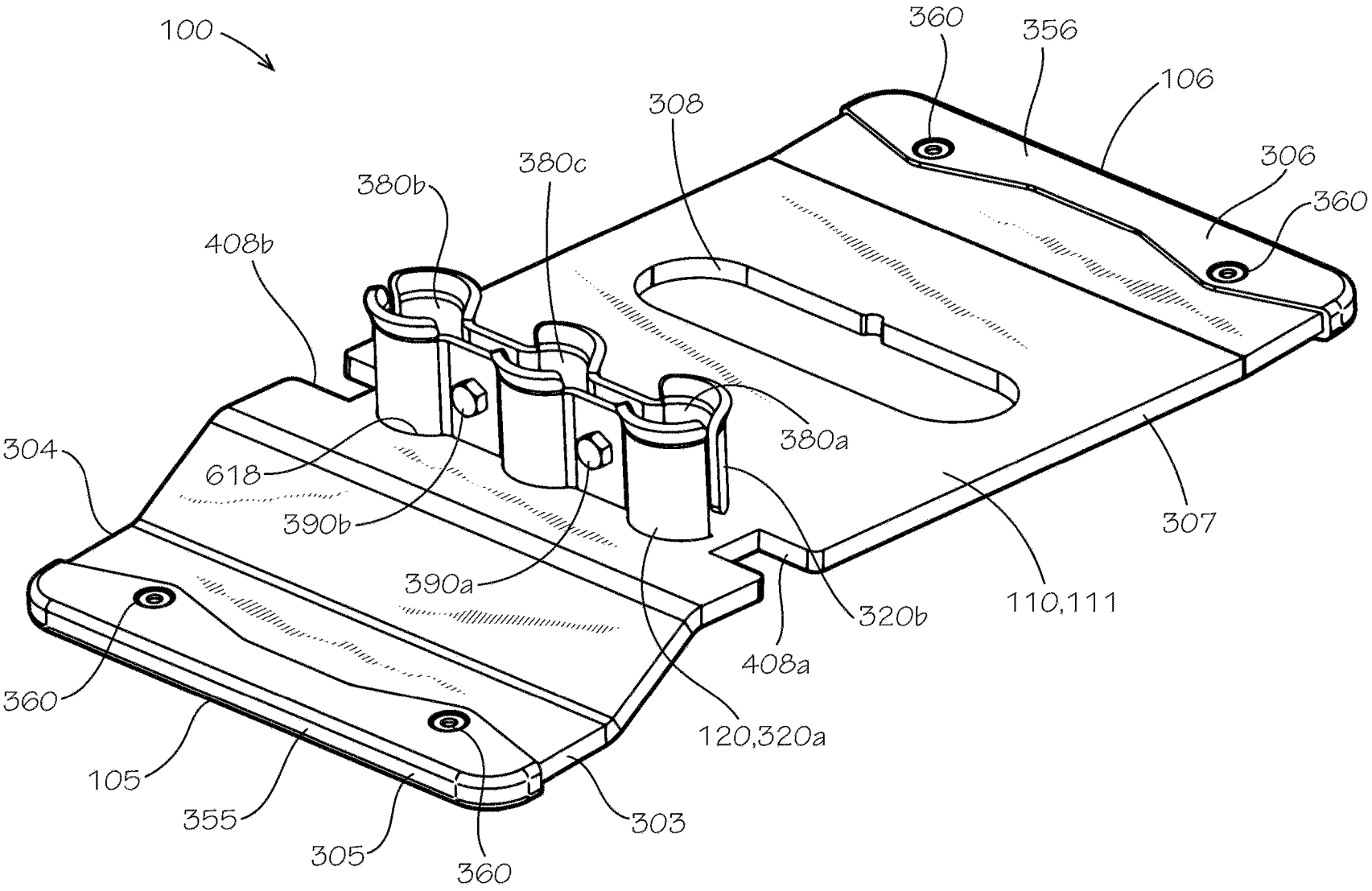
FIG. 3 is a top perspective view of the guardrail base of FIG. 2.

FIG. 3 is a top perspective view of the guardrail base 100. The guardrail base 100 can comprise the base body 110 and the rail mount 120, which can be received within or on and fixed with respect to the base body 110. The base body 110 can comprise the first foot 305, the second foot 306, which can be separated by a predetermined distance from and distal from the first foot 305, and a raised portion 307 extending between the first foot 305 and the second foot 306. The raised portion 307 can help ensure that the feet 305,306 touch the surface 51 (shown in FIG. 1) of the structure 50 (shown in FIG. 1) and that all of the weight of the guardrail system 80 is transferred to and supported by the surface 51 through the feet 305,306—optionally through foot covers 355,356. Even when the surface 51 or the guardrail base 100 is not perfectly flat due to the presence of protrusions (whether defects or simply intended features of the structure), the guardrail base 100 can still sit flat on the surface 51. Each of the first foot 305, the second foot 306, and the raised portion 307 can extend from a first transverse end 303 defined in the guardrail base 100 to a second transverse end 304 defined in the guardrail base 100. The base body 110 can define a top surface 111 and a bottom surface 112 (shown in FIG. 6). The top surface 111 can be spaced apart or offset from the bottom surface 112 by a thickness T110 (shown in FIG. 6) of the base body 110. In some aspects, each of the first foot 305 and the second foot 306 can be a panel or plate, which can be substantially planar (i.e., planar minus any local recesses, or protrusions and not defining an overall curved shape in cross-section). More specifically, at least a portion of the first foot 305 can be substantially parallel to or even coplanar with at least a portion of the second foot 306. The base body 110 can further define notches 408*a.b.*

The guardrail base 100 can comprise a first foot cover 355 configured to cover at least a portion of the first foot 305, and a second foot cover 356 configured to cover at least a portion of the second foot 306. In one aspect, the first foot cover 355 and the second foot cover 356 can be formed from an impact-resistant and/or slip-resistant material such as, for example and without limitation, rubber or silicone. The first foot cover 355 and the second foot cover 356 can cover at least a portion of the bottom surface 112 of the base body 110 to prevent or reduce damage to the base body 110 or to the surface 51 (shown in FIG. 1) when the guardrail base 100 is positioned on the surface 51. Furthermore, the first foot cover 355 and the second foot cover 356 can prevent or reduce slipping of the base body 110 and thus the guardrail base 100 relative to the surface 51.

In one aspect, at least one bore 1060 (shown in FIG. 10) can be defined in either or both of the first foot 305 and the second foot 306 of the base body 110. The bore 1060 can extend from the top surface 111 to the bottom surface 112, and a fastener 360 such as, for example and without limitation, a screw, a bolt, a rivet, or a pin can be inserted through the bore 1060. In some aspects, the fastener 360 can extend through the base body 110 to secure the foot covers 355,356 to the respective feet 305,306. In some aspects, the fasteners 360 can extend through the base body 110 and into the surface 51 to securely attach the base body 110 to the surface 51, either by extending through the bores 1060 or by extending through one or more other bores defined in the guardrail base 100. In some aspects, at least one cutout 308 can be defined in a portion of the base body 110, such as the first foot 305, the second foot 306, and/or the raised portion 307. As shown, the cutout 308 is defined in the raised portion 307. The cutout 308 can facilitate compact and stable stacking of a plurality of guardrail bases 100 by providing sufficient clearance for passage of the rail mount 120 of a second guardrail base 100 (spun 180 degrees about a vertical axis, for example, and positioned underneath the first guardrail base 100) and/or can facilitate carrying of the guardrail base. The cutout 308 can further reduce the weight of the guardrail base 100 without reducing its strength. As shown, each of the base body 110 and the foot covers 355,356 and any other portion of the guardrail base 100 can define radii at outside corners to avoid sharp points on portions of the guardrail base 100.

The rail mount 120 can comprise a fixed clamp body 320*a*, which can be secured to the base body 110, and a floating clamp body 320*b*, which can be offset from and coupled to the fixed clamp body 320*a*. The fixed clamp body 320*a* can be secured to the base body 110 with a fastener or a fastening material. In some aspects, the fastener or the fastening material can be a weldment formed by welding. In some aspects, the fastener or the fastening material can comprise a threaded or pinned connection. In some aspects, as shown, the fixed claim body 320*a* can be received within and interlock with the base body 110 to facilitate a connection therebetween. More specifically, the base body 110 can define an opening 618 (shown also in FIG. 6), which can be defined in and extend between the top surface 111 and the bottom surface 112 and within which the fixed clamp body 320*a* can be received.

As will be described in further detail below, the floating clamp body 320*b* can be coupled to the fixed clamp body 320*a* with one or more fastening assemblies 390*a,b*, and the floating clamp body 320*b* and the fixed clamp body 320*a* can together define the post bores 380*a,b,c*.

Figure 4:
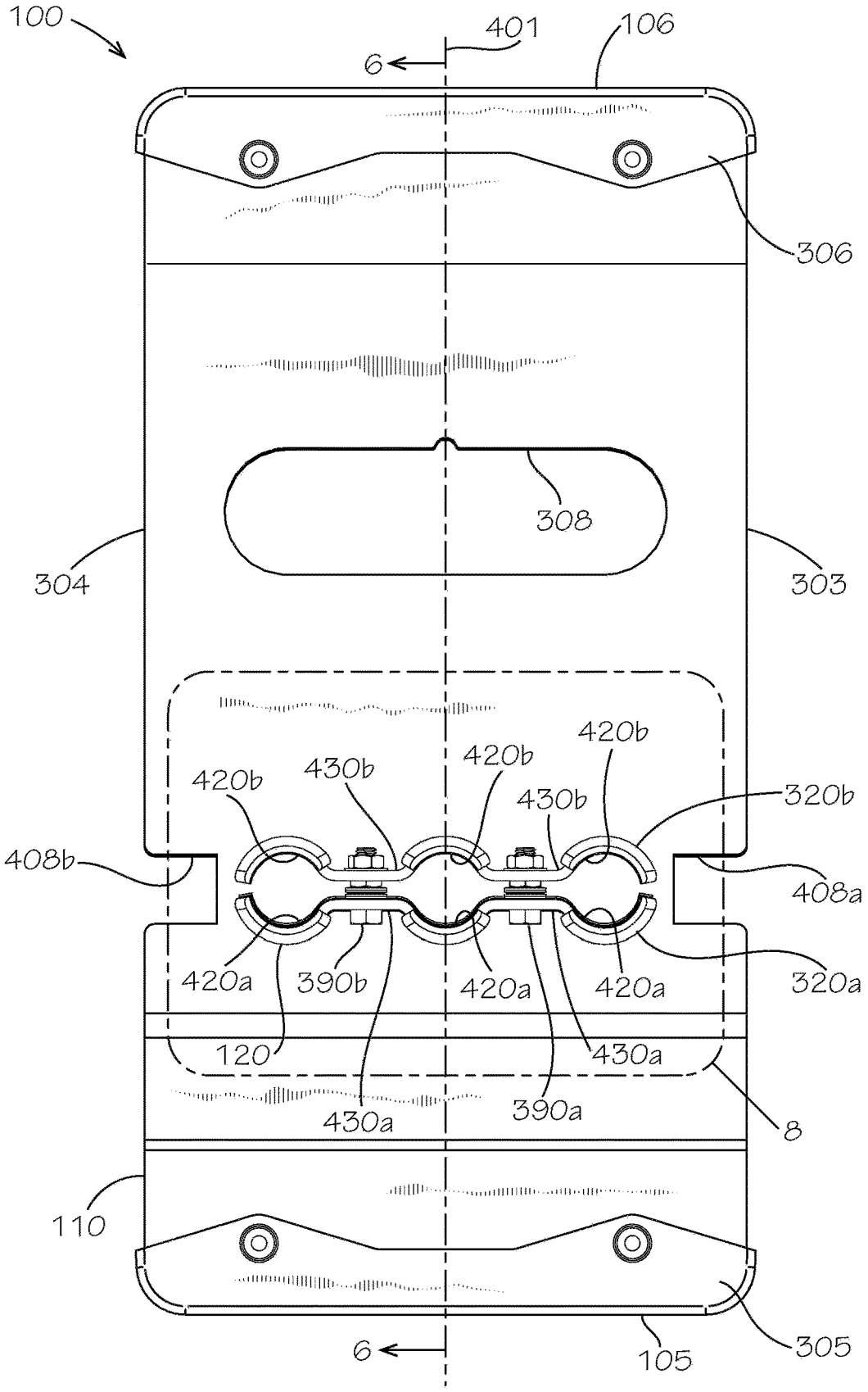
FIG. 4 is a top plan view of the guardrail base of FIG. 2.

FIG. 4 is a top plan view of the guardrail base 100, which can be symmetric about a centerline 401. In some aspects, the guardrail base can define a substantially rectangular shape overall (i.e., rectangular in shape minus any notches, chamfers, or other edge treatments). In some aspects, the guardrail base can define a non-rectangular shape overall. In some aspects, as shown, each of the fixed clamp body 320*a* and the floating clamp body 320*b* can define a wavy or undulating shape or pattern. More specifically, one or more curved portions 420*a,b* of each of the fixed clamp body 310 and the floating clamp body 320 can be configured to receive one or more of the posts 92 (shown in FIG. 1), and one or more connecting portions 430*a,b*, which can define a straight or flat shape, can be configured to receive the one or more of the fastening assemblies 390*a,b*. The curved portions 420*a,b* and the connecting portions 430*a,b* can alternate from a first end of the rail mount 120, which can be proximate to the first transverse end 303 of the guardrail base 100, to a second end of the rail mount 120, which can be proximate to the second transverse end 304 of the guardrail base 100. Again, the base body 110 of the guardrail base 100 can define the notches 408*a,b*, which can be aligned with the rail mount 120.

Figure 5:
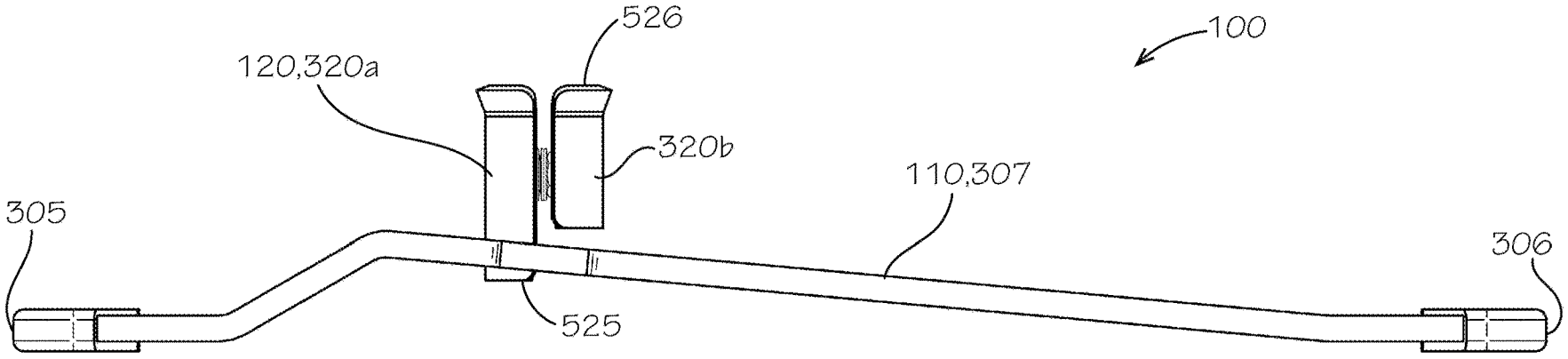
FIG. 5 is a side elevation view of the guardrail base of FIG. 2.

FIG. 5 is a side elevation view of the guardrail base 100. The rail mount 120 can be positioned between the feet 305,306 and can extend vertically from base body 110 and, more specifically, from the raised portion 307. A top portion or top end 526 of the rail mount 120 can extend vertically above the base body 110, and a bottom portion or bottom end 525 of the rail mount 120 can extend vertically below the base body 110. As shown, a height of the fixed claim body 320*a* can be taller than a height of the floating clamp body 320*b*.

Figure 6:
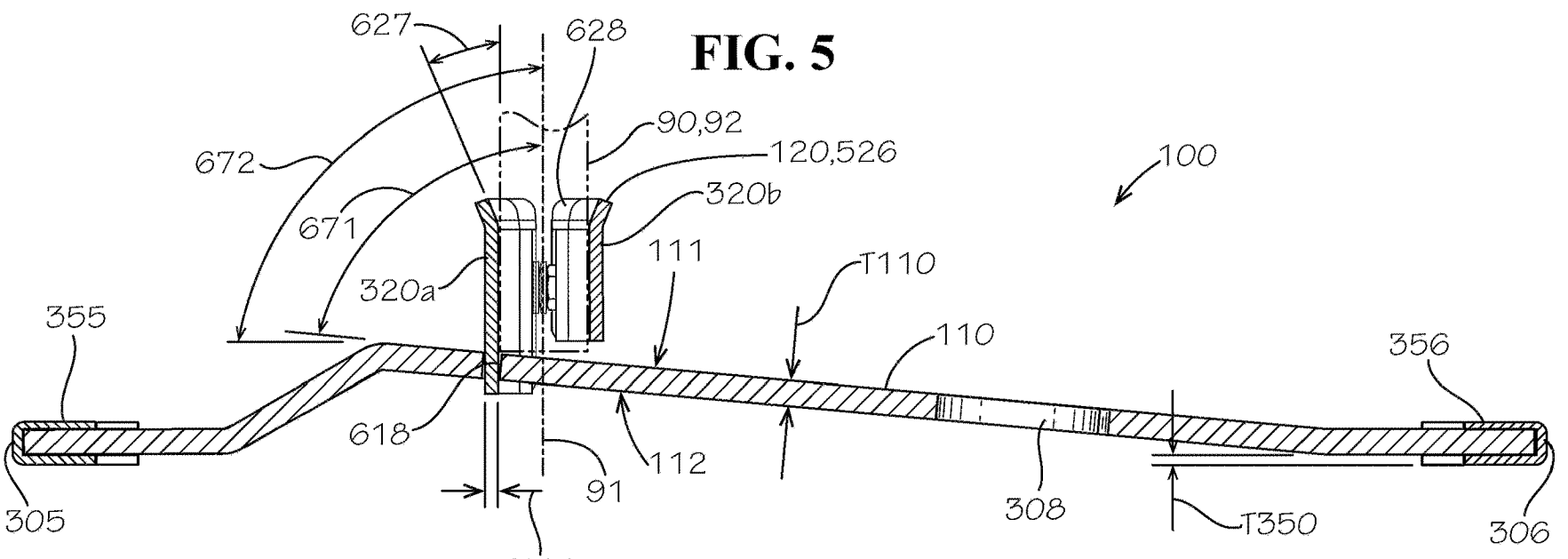
FIG. 6 is a partial sectional view of the guardrail base of FIG. 2 taken along line 6-6 of FIG. 4.

FIG. 6 is a partial sectional view of the guardrail base 100 taken along line 6-6 of FIG. 4. A bore such as any of the bores 380*a,b,c* (shown in FIG. 3) can define a flared entrance or opening 628 defining a flare angle 627 at the top end 526 of the rail mount 120 to facilitate insertion of the post 92, which is shown in broken lines so as not to obscure the structure of the rail mount 120. A full open angle of the flared opening 628 can measure twice the flare angle 627. As shown, the top surface 111 of the base body 110 can define a stop surface against which the post 92 can contact. In some aspects, the post 92 can be supported directly by the top surface 111. In some aspects, the post 92 and the top surface 111 can define a gap therebetween. As shown, the thickness T110 of the base body 110 can be constant across any portion or entirety of the base body 110, as can be a thickness T120 of the rail mount 120 and a thickness T350 of the foot covers 355,356.

As shown, the rail mount 120 can positively fix an angle 671 of an axis 91 of a post 92 of the guardrail 90 with respect to the guardrail base 100 and an angle 672 of the axis 91 with respect to the horizontal. By positively fixing the angles 671,672, the rail mount 120 can prevent rocking of the post 92 about any one or more axes by clamping tightly an outside surface of the post 92 with walls of the fixed clamp body 320*a* and the floating clamp body 320*b*. The angles 671,672 can thereby be maintained and the guardrail 90 can thereby remain solidly fixed in position with respect to the surface 51 (shown in FIG. 1) on which the guardrail system 80 (shown in FIG. 1) can be placed.

Figure 7:
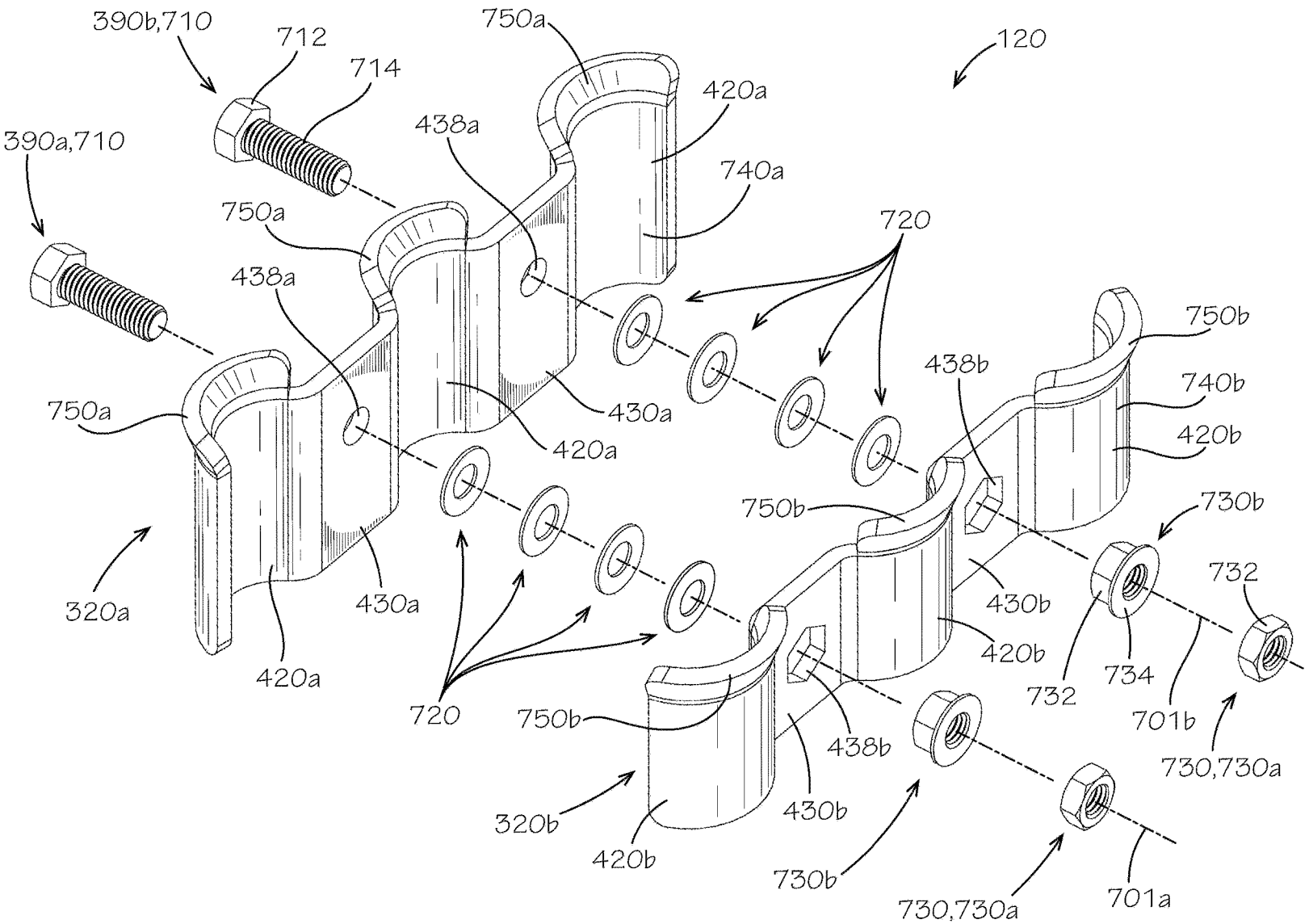
FIG. 7 is an exploded top perspective view of a rail mount of the guardrail base of FIG. 2.

FIG. 7 is an exploded top perspective view of the rail mount 120 of the guardrail base 100 (shown in FIG. 1). The curved portions 420*a,b* of each of the fixed clamp body 320*a* and the floating clamp body 320*b* can comprise flanges 750*a,b*, which can extend upward from a main portion 740*a,b* of the respective clamp body 320*a,b* and can define at least in part the flared opening 628 (shown in FIG. 6) and the flare angle 627 (shown in FIG. 6). Each of the main portions 740*a,b* can be oriented vertically. Any one of the fastening assemblies 390*a,b* can comprise one or more of a fastener 710, a spring element 720, and a nut 730, and of which can be configured to engage with each other as shown.

The connecting portions 430*a,b* of each of the fixed clamp body 320*a* and the floating clamp body 320*b* can define openings 438*a,b*, which can be bores, sized and otherwise configured to receive the fastening assembles 390*a,b* and, more specifically, the fasteners 710. In some aspects, one or more of the openings 438*a,b* can define a circular shape, which can allow free rotation of a portion of the fastening assembles 390*a,b* such as, for example and without limitation, the fasteners 710. In some aspects, one or more of the openings 438*a,b* can define a non-circular shape, which can fix a rotational orientation of a portion of the fastening assembles 390*a,b* such as, for example and without limitation, nuts 730. Locking a rotational orientation of a first portion of the fastening assembles 390*a,b* while allowing a second portion of the fastening assembles 390*a,b* to rotate can facilitate engagement of mating threads and tightening of the fastening assembles 390*a,b* thereby. Locking an angular or rotational orientation of the nut 730 by defining a matching shape in at least one of the clamp bodies 320*a,b* can eliminate the need for a separate fastener or fastening connection (e.g., a weldment) to lock the orientation. In some aspects, as shown, a center of each of the openings such as the openings 438*b* can be positioned halfway between a bottom end and a top end of the main portion 740*b* of the floating clamp body 320*b*. This can facilitate a secure grip on the post 92 (shown in FIG. 1) by positioning each of the fastening assemblies 390*a,b* in a center of a portion of a surface of the floating clamp body 320*b* that is in contact with the post 92. In some aspects, as shown, a center of each of the openings such as the openings 438*a* can be closer to the top end (or the bottom end) of the main portion 740*b*.

The fastener 710, which can be a shafted fastener and can comprise or define external threading as shown, can comprise a head 712 and a shaft 714 extending from the head 712. The head 712 can define a polygonal shape such as that of a hexagon to facilitate tightening of the fastening assembles 390*a,b* with a tool defining a matching shape (e.g., a hex wrench or socket). As shown, the head 712 of each of the fasteners 710 can be positioned outside the fixed clamp body 320*a* with respect to a space between the fixed clamp body 320*a* and the floating clamp body 320*b*, and the shaft 714 of each of the fasteners 710 can extend through one of the fixed clamp body 320*a* and the floating clamp body 320*b* and into the space between the fixed clamp body 320*a* and the floating clamp body 320*b*. The shaft 714 can define a circular cross-section and can extend through the fixed clamp body 320*a*.

Figure 8:
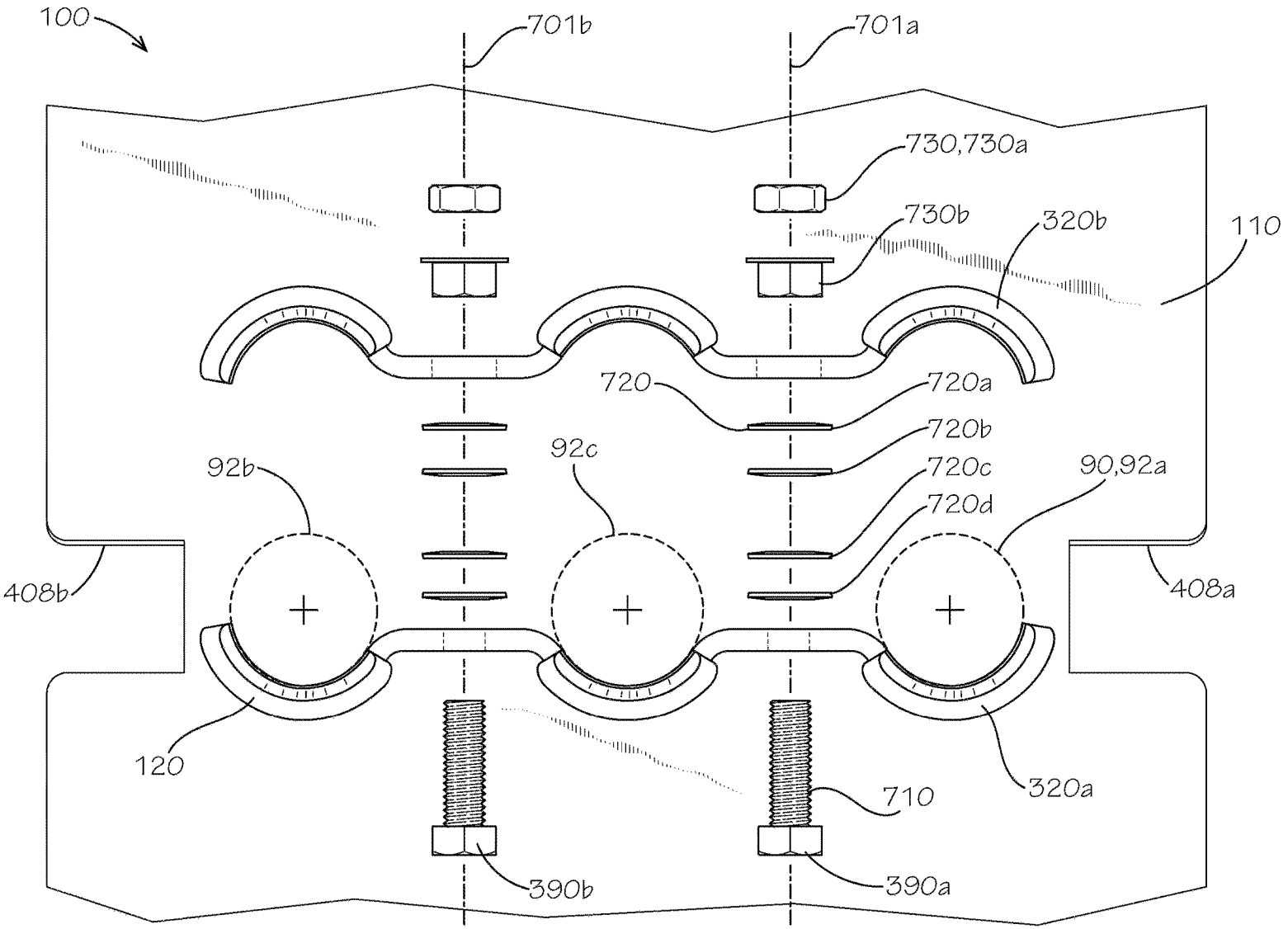
FIG. 8 is a top plan view of the guardrail base of FIG. 2 comprising the rail mount of FIG. 7 taken from detail 8 of FIG. 4 but showing the rail mount in an exploded or unassembled condition.

One or more of the spring elements 720 can be positioned between the fixed clamp body 320*a* and the floating clamp body 320*b*. In some aspects, the spring element 720 can be a spring washer. More specifically, the spring element 720 can be a Belleville washer, which is a type of spring washer defining conical end surfaces. In some aspects, the fastening assemblies 390*a,b* can comprise a single spring element 720. In some aspects, the fastening assemblies 390*a,b* can comprise a plurality of spring elements 720. In some aspects, as shown, the fastening assemblies 390*a,b* can comprise an even number of spring elements 720, and the spring elements 720 can be arranged in pairs, in which case each spring element 720 of the pair can be opposing, i.e., can face in opposite directions. For example, as shown in FIG. 8, a concave or recessed inner surface of a first spring element 720*a* of one of such pairs of spring elements 720 can face a concave or recessed inner surface of a second spring element 720*b* of one of such pairs of spring elements 720. Similarly, as shown, a concave or recessed inner surface of a third spring element 720*c* of a second pair of spring elements 720 can face a concave or recessed inner surface of a fourth spring element 720*d* of the second pair of spring elements 720. Convex or protruding outer surfaces of spring elements such as adjacent spring elements 720*b,c* can contact each other. In some aspects, any one or more of the spring elements 720 can be any compressible spring-like structure (i.e., any structure storing potential energy upon compression) including, for example and without limitation, a spring storing potential energy upon compression of a material forming the spring (e.g., a cylindrical or other rubber spring) or a spring storing potential energy upon compression of a plurality of wire coils or flat annular discs or rings forming the spring (e.g., in a coil spring or a disc spring, respectively).

One or more of the nuts 730, each of which can in some aspects be a spacer, can comprise or define internal threading as shown and can comprise a body 732 (in the case of either a nut 730*a* without a flange or a flanged nut 730*b*) and a flange 734 extending from the body 732 (in the case of the flanged nut 730*b*). More specifically, one or more of the fastening assemblies 390*a,b* can comprise at least one of the nuts 730*a* and at least one of the nuts 730*b*. The body 732 of each nut 730 can define a polygonal shape such as that of a hexagon to facilitate tightening of the fastening assembles 390*a,b* with a tool. As shown, the flange 734 of each of the nuts 730 can be positioned outside the floating clamp body 320*b* with respect to a space between the fixed clamp body 320*a* and the floating clamp body 320*b*, and the body 732 of each of the nuts 730 can extend through or at least into one of the fixed clamp body 320*a* and the floating clamp body 320*b* and into the space between the fixed clamp body 320*a* and the floating clamp body 320*b*. Positioning of the flange 734 outside the floating clamp body 320*b* can facilitate tightening of the rail mount 120 in that tightening of the fastening assemblies 390*a,b* can bring the fixed clamp body 320*a* and the floating clamp body 320*b* closer to each other. As shown, the body 732 of each of the nuts 730 can extend through the floating clamp body 320*b*. One or more of the nuts 730 can be positioned outside the floating clamp body 320*b* with respect to a space between the fixed clamp body 320*a* and the floating clamp body 320*b*. An axis of the nut 730*a* can be aligned with an axis of the nut 730*b* or the axis of any other component of the fastening assemblies 390*a,b* or the fastening axes 701*a,b*. The nut 730*a* can be positioned adjacent to the nut 730*b* or any other component of the fastening assemblies 390*a,b*, and the nut 730*a* can be configured to tighten against the nut 730*b* to lock the angular orientation of each of the nuts 730*a,b* as well as the corresponding fastening assembly 390*a,b*.

In some aspects, one or more of the fastener 710 and the nut 730 of the fastening assembly 390*a,b* can comprise fastening elements other than threading or in addition to threading. For example and without limitation, the fastener 710 or the fastening assemblies 390*a,b* can be tightenable with a cam structure such as when the fastening assembly 390*a,b* comprises a cam-lock and/or lever fastener such as, for example and without limitation, that which is used to secure a quick-connect bicycle wheel to a front fork or a rear fork of a bicycle frame.

FIG. 8 is a top plan view of the rail mount 120 taken from detail 9 of FIG. 4 but shown in an exploded or unassembled condition. As shown, each of the fastening assemblies 390*a,b* can comprise two pairs of spring elements 720, i.e., four spring elements 720, which can be the aforementioned Belleville washers, positioned between the fixed clamp body 320*a* and the floating clamp body 320*b*. The posts 92*a,b,c* are shown in contact with the fixed clamp body 320*a* but need not be positioned between the fixed clamp body 320*a* and the floating clamp body 320*b* before assembly of the floating clamp body 320*b* to the fixed clamp body 320*a*. More specifically, as shown, the rail mount 120 and the guardrail base 100 more generally can be configured to receive any one or more of the posts 92*a,b,c* after such assembly, which can greatly simplify the assembly process as a user need not maintain a position or orientation of the posts 92*a,b,c* in place inside the rail mount 120 while tightening the fastening assemblies 390*a,b*. Until received within the guardrail base 100, the guardrails 90 can be heavy and unstable given their size.

Figure 9:
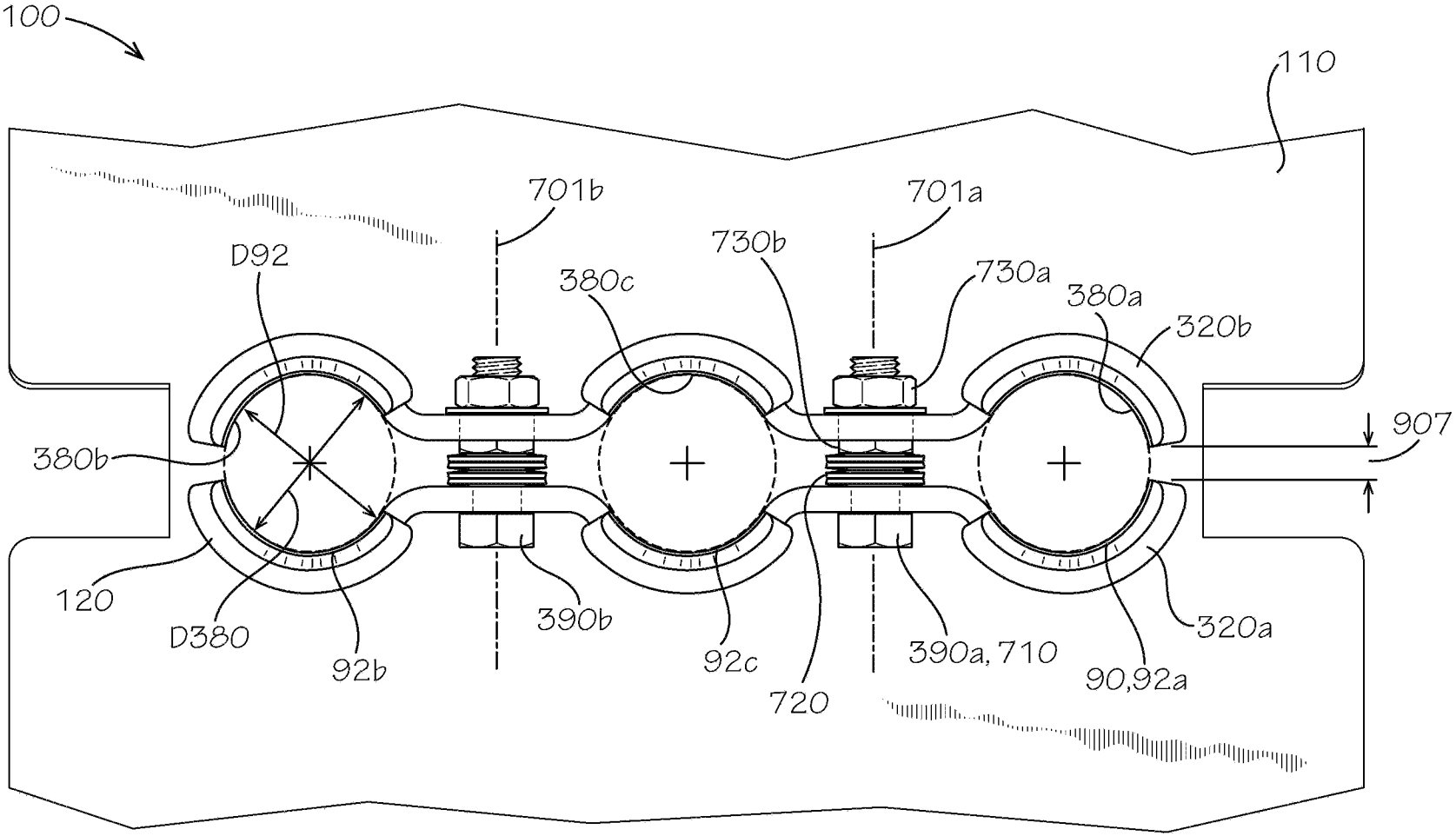
FIG. 9 is a top plan view of the guardrail base of FIG. 2 comprising the rail mount of FIG. 7 taken from detail 8 of FIG. 4.

FIG. 9 is a top plan view of the rail mount 120 of FIG. 7 taken from detail 9 of FIG. 4 and showing the rail mount 120 in an assembled condition. Again, the rail mount 120 can define a plurality of post bores 380*a,b,c* in an assembled condition, and each of the post bores 380 *a,b,c* can be configured to receive the respective post 92*a,b,c* of the guardrail 90. A first or untightened bore diameter D380 of each of the bores 380*a,b,c* can be equal to or larger than a diameter D92 of the respective post 92*a,b,c* when the fastening assemblies 390*a,b* are assembled but before any compressive load is placed on the spring elements 720. The spring elements 720 in such an uncompressed condition can, in effect, set or maintain a minimum value of the first bore diameter D380 sufficient to permit ready insertion of the posts 92*a,b,c*, i.e., insertion without adjustment of the tightness of the fastening assemblies 390*a,b* or the use of tools to force insertion. The spring elements 720 in a compressed condition (not shown) after tightening of the fastening assemblies 390*a,b* can permit tight clamping of the fixed clamp body 320*a* and the floating clamp body 320*b* about any one or more of the posts 92*a,b,c*. By use of the spring elements, a tool can be used to tighten the fastening assemblies 390*a,b* to a torque below that necessary to compress the spring elements 720. A user can thereby quickly and easily tighten the rail mount 120 without pre-insertion of the posts 92*a,b,c*. More specifically, the user can achieve a predetermined bore diameter D380 sufficiently large to receive any of the posts 92*a,b,c* but also sufficiently small to hold the guardrails 90 sufficiently vertical for stability without slow and deliberate tightening or trial-and-error tightening and loosening of the fastening assemblies 390*a,b*. Moreover, based on an increase or decrease in the diameter D92 of the posts 92*a,b,c* used in the guardrail 90 the number of spring elements 720 can be increased as desired. In any case, tightening the fastening assemblies 390*a,b* to a torque necessary to compress the spring elements 720 can cause the bores 380*a,b,c* to define a second or tightened bore diameter (not shown) to positively secure the posts 92*a,b,c* inside the rail mount 120 and thereby fix the angles 671,672 (shown in FIG. 6). A difference between the first diameter D380 and the second diameter can be adjusted to allow for more or greater compression by increasing an axial height of one or more of the spring elements 720. Instead of Belleville washers or together with Belleville washers, other spring elements 720 including any of the aforementioned spring-like structures can also be used.

The rail mount 120 and, more specifically, each of the fixed clamp body 320*a* and the floating clamp body 320*b* can define an offset distance 907 therebetween to ensure that the fastening assemblies 390*a,b* of the rail mount 120 can be tightened as much as needed or desired to secure the posts 92*a,b,c* or to limit tightening to a certain level of tightening (by configuring the fixed clamp body 320*a* and the floating clamp body 320*b* to touch at a point corresponding to that level, for example).

Figure 10:
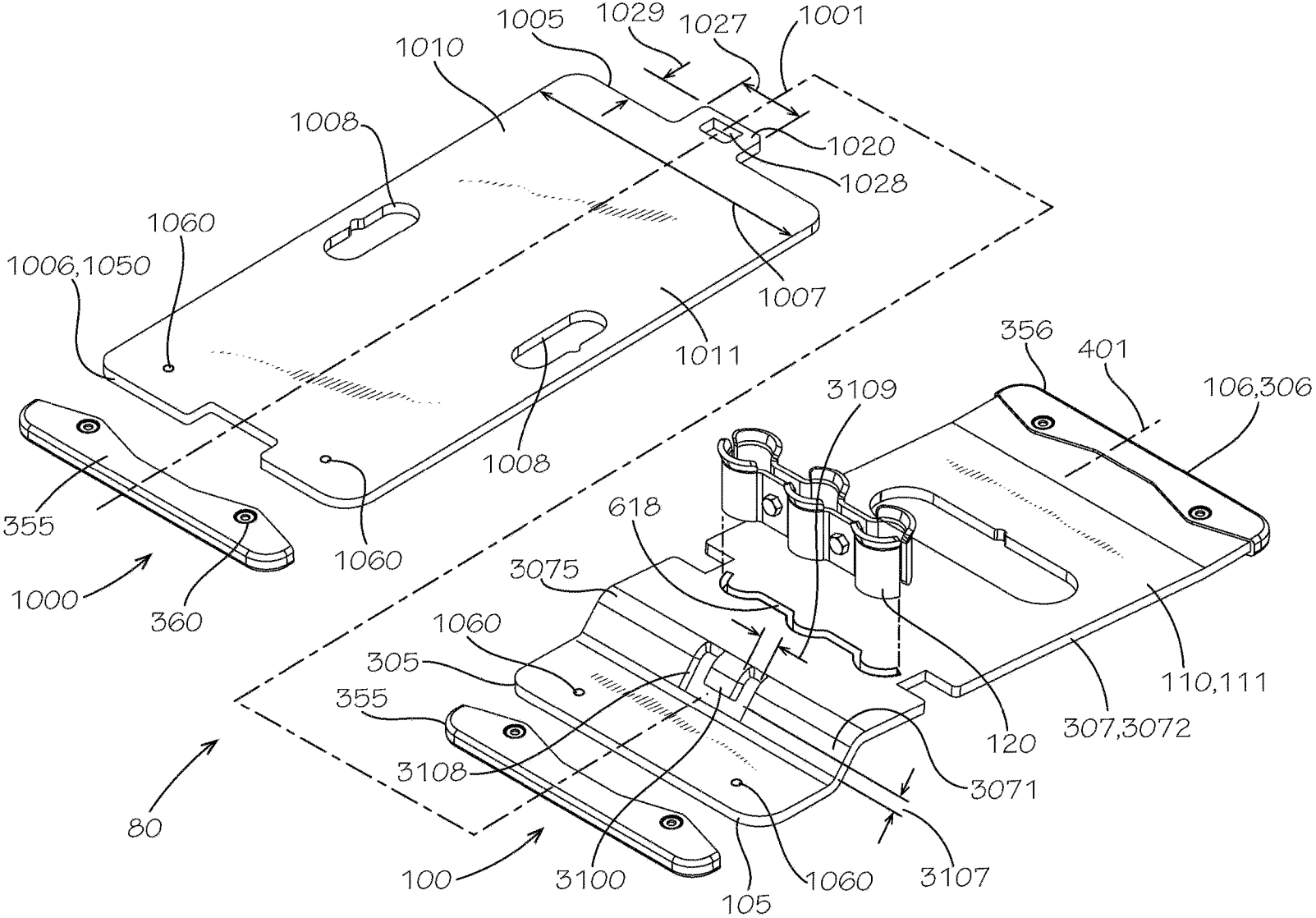
FIG. 10 is a partially exploded top perspective view of the guardrail base of FIG. 2 in accordance with another aspect of the current disclosure shown together with a base extension before engagement of the guardrail base with the base extension in accordance with one aspect of the current disclosure.

FIG. 10 is an exploded top perspective view of the guardrail system 80 comprising the guardrail base 100 in accordance with another aspect of the current disclosure shown together with a base extension 1000 before engagement of the guardrail base 100 with the base extension 1000 in accordance with one aspect of the current disclosure. As shown, the raised portion 307 of the guardrail base 100 and, more specifically, the base body 110 can comprise a first panel 3071 extending from the first end 105 of the guardrail base 100 and towards the rail mount 120 and a second panel 3072 extending from the second end 106 of the guardrail base 100 and also towards the rail mount 120. In some aspects, each of the first panel 3071 and the second panel 3072 can be substantially flat (i.e., flat minus any openings, recesses, or protrusions and not defining an overall curved shape in cross-section). The base body 110 can define a bend or transition portion 3075 at an intersection of the first panel 3071 and the second panel 3072. At least one of the first panel 3071 and the second panel 3072 can comprise a tab 3100. The base body 110 can define a tab surround opening 3108, which can surround the tab 3100. As shown, the tab 3100 can be parallel to the first panel 3071, and each of the first panel 3071 and the tab 3100 can be angled with respect to the feet 305,306 and the second panel 3072. As shown, the tab surround opening 3108 can be U-shaped. The base body 110 can define a gap 3107 between a distal end of the tab 3100 and a portion of the base body 110 nearest to the tab 3100 along a direction of the centerline 401, and the base body 110 can define gaps 3109 between each side of the tab 3100 and a portion of the base body 110 nearest to the tab 3100 in a direction that is orthogonal to the direction of the centerline 401.

The base extension 1000, which can define a centerline 1001 and can align with the centerline 401 of the guardrail base 100, can comprise a base extension body 1010 and can define a first end 1005 and a second end 1006. The second end 1006 can define a foot 1050 and can be sized to receive or be covered by a cover such as one of the foot covers 355,356, which can function as the foot covers 355,356 optionally covering the feet 305,306 of the guardrail base 100 (and is shown in FIG. 10 unassembled from the base extension 1000). In one aspect, at least one of the bores 1060 can be defined in or proximate to the second end 1006 of the base extension 1000. The bore 1060 can extend from a top surface 1011 to a bottom surface 1012 (shown in FIG. 12), and a fastener such as the fastener 360 can be inserted through the bore 1060. In some aspects, the fastener 360 can extend through the base extension body 1010 to secure the foot cover 355 to the base extension body 1010. In some aspects, the fasteners 360 can extend through the base extension body 1010 and into the surface 51 (shown in FIG. 1) to securely attach the base extension body 1010 to the surface 51, either by extending through the bores 1060 or by extending through one or more other bores defined in the base extension 1000.

In some aspects, at least one cutout 1008 can be defined in a portion of the base extension 1000 and, more specifically, the base extension body 1010. As shown, the cutouts 1008 can be defined between the first end 1005 and the second end 1006. The cutout 1008 can facilitate compact and stable stacking or hanging of a plurality of base extensions 1000 and/or can facilitate carrying of the guardrail base 100. The cutouts 1008 can further reduce the weight of the base extension 1000 while maintaining its overall size. As shown, each of the base extension body 1010 and any other portion of the base extension 1000 can define radii at outside corners to avoid sharp points on portions of the base extension 1000.

The base extension 1000, which can be planar as shown, can define a connector or tab 1020 and an engagement opening 1028. The tab 1020 can be formed integrally with the base extension body 1010 of the base extension 1000 and extend from the first end 1005 thereof. With or without the tab 1020, the base extension 1000 can define the engagement opening 1028 proximate to the first end 1005, and the engagement opening 1028 can be sized and otherwise configured to receive the tab 3100 of the guardrail base 100. The engagement opening 1028 can be sized and otherwise configured to lockably engage the tab 3100. In some aspects, the tab 1020 can define the engagement opening 1028. The tab 1020 of the base extension 1000 can define a width 1027 measuring less than an overall width 1007 of the base extension 1000. The tab 1020 can extend a distance 1029 from a remaining portion of the base extension body 1010 in the direction of the centerline 1001.

Figure 11:
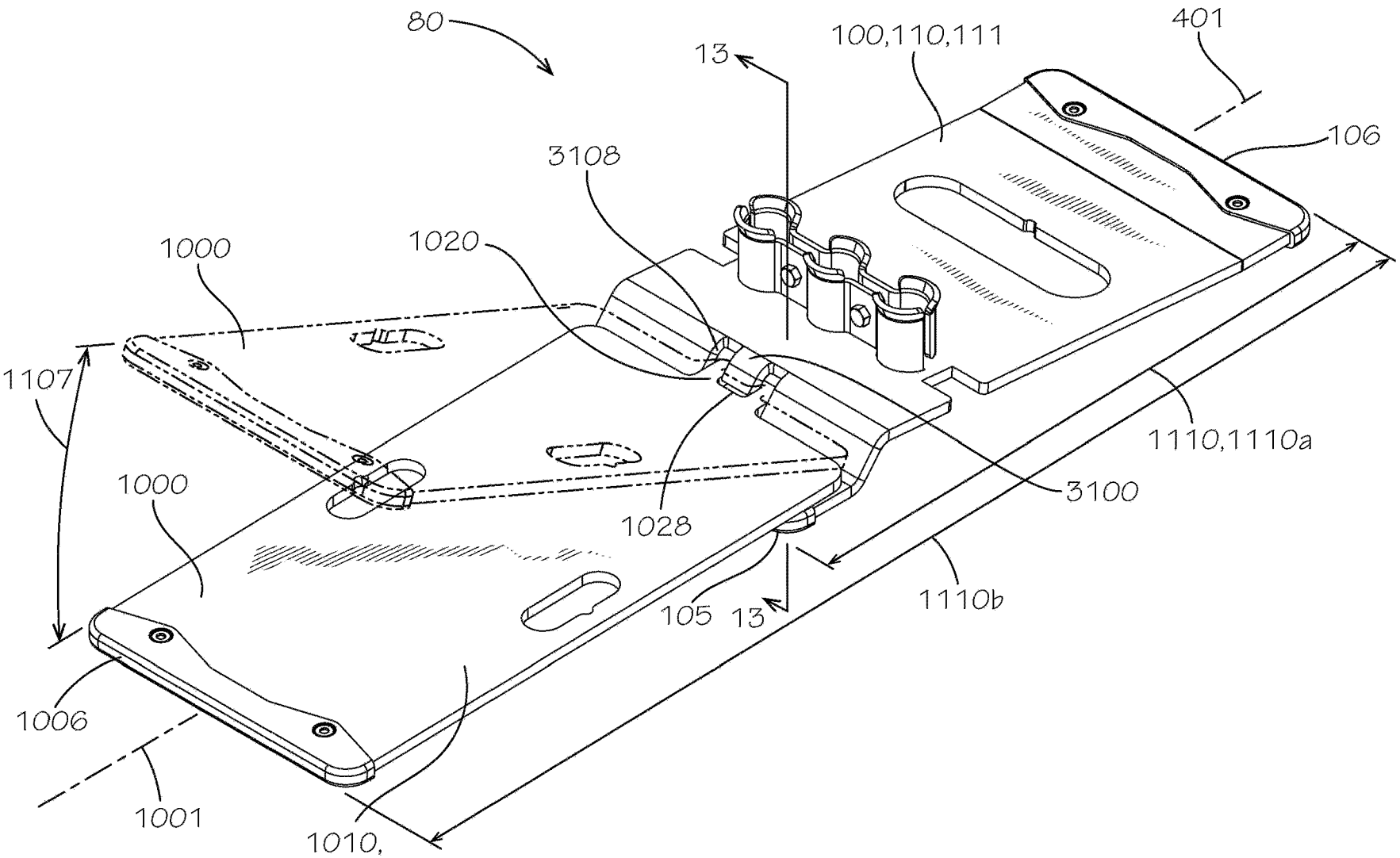
FIG. 11 is a top perspective view of the guardrail base of FIG. 10 shown during and after engagement with the base extension.

FIG. 11 is a top perspective view of the guardrail base 100 shown during and after engagement with the base extension 1000. Before engagement with the base extension 1000, the guardrail base 100 can define a first effective support length 1110*a* of the guardrail system 80. The effective support length is a distance in the horizontal direction between extreme ends of the guardrail system 80 that are configured to contact and be supported by the surface 51 (shown in FIG. 1) and are configured to move as one piece or otherwise move together (i.e., not rotate with respect to one another) upon lifting and rotation of the guardrail system 80 with respect to the surface 51 when a horizontal load acts on the guardrail 90 (shown in FIG. 1) received within and supported by the guardrail base 100 at least partly in the direction of the centerlines 401,1001. More specifically, the first effective support length 1110*a* can be defined by a distance between the second end 106 and the first end 105 of the guardrail base 100. Without the base extension 1000 lockably engaged with the guardrail base 100, the effective support length 1110 of the guardrail base 100 can be the length of the guardrail base 100. A longer or extended second effective support length 1110*b* can be defined by a distance between the second end 106 of the guardrail base 100 and the second end 1006 of the base extension 1000.

Based on the effective support length 1110*a*, the guardrail base 100 can by itself resist the aforementioned lifting and rotation due its own weight and size. When engaged with the guardrail base 100, the base extension 1000 can thereby extend the effective support length 1110, and a horizontal load acting on the guardrail 90 (shown in FIG. 1) that could otherwise result in lifting and rotation of the guardrail base 100 can be resisted without any lifting and rotation of the guardrail base 100 and the base extension 1000. The guardrail base 100 and the base extension 1000 can together resist such lifting and rotation due to the combined weight and length of such portions and surrounding portions of the guardrail system 80. The guardrail base 100 and the base extension 1000 can be configured to move together by interaction and engagement between the tab 3100 of the guardrail base 100 and the engagement opening 1028 of the base extension 1000.

As shown, the base extension 1000 can be engaged with the guardrail base 100 by inserting the tab 1020 of the base extension 1000 into the tab surround opening 3108 of the guardrail base 100, including by rotating the base extension 1000 with respect to the guardrail base 100 by a rotation angle 1107 as necessary. By requiring rotation of the base extension 1000 with respect to the guardrail base 100 during assembly of the base extension 1000 to the guardrail base 100, shifting of the base extension 1000 with respect to the guardrail base 100 after assembly (i.e., when both the base extension 1000 to the guardrail base 100 are in contact with the surface 51) can be prevented.

Figure 12:
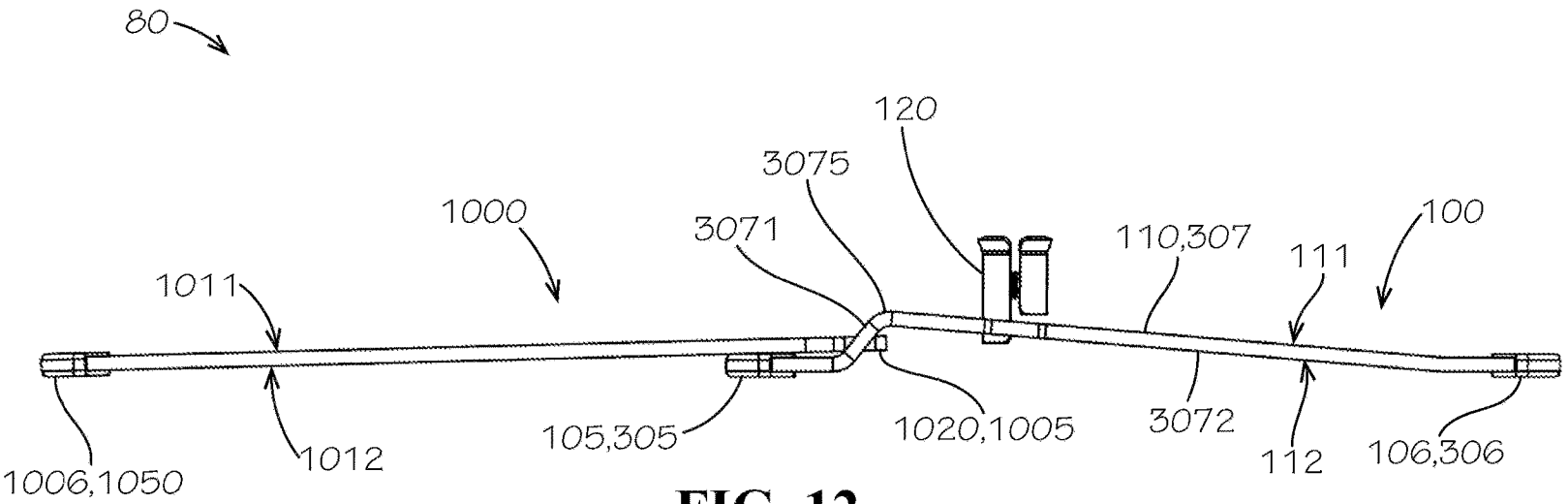
FIG. 12 is a side elevation view of the guardrail base and the base extension of FIG. 10.
Figure 13:
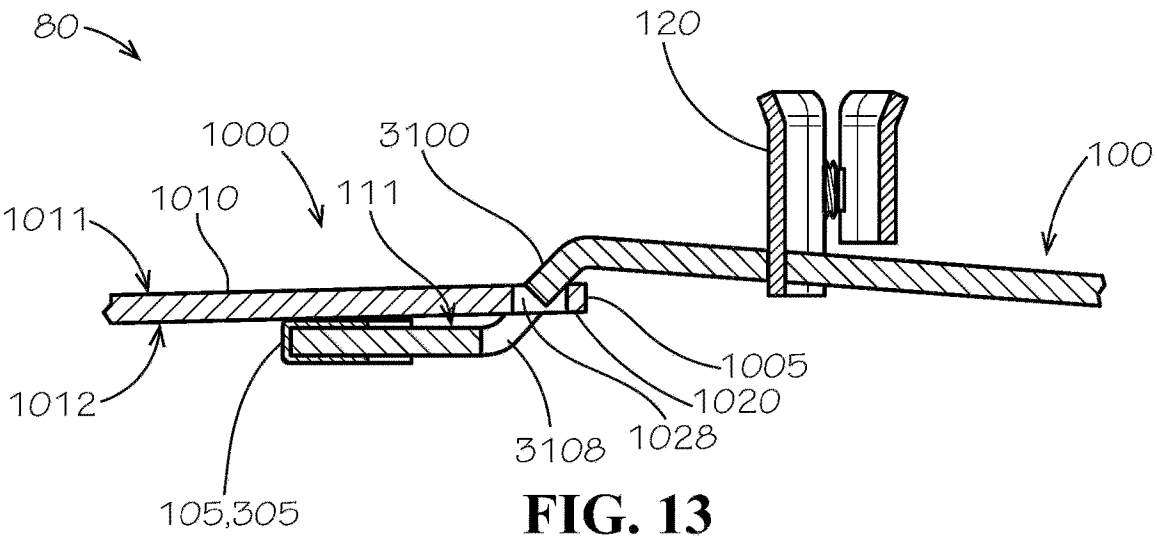
FIG. 13 is a partial sectional view of the guardrail base and the base extension of FIG. 10 taken along line 13-13 of FIG. 11.

FIG. 12 is a side elevation view of the guardrail base 100 and the base extension 1000 in a final assembled position, and FIG. 13 is a partial sectional view of the guardrail base 100 and the base extension 1000 in the same position taken along line 13-13 of FIG. 11. As shown, in the final assembled position in which the guardrail base 100 and the base extension 1000 can be engaged with each other, at least a portion of the bottom surface 1012 of the base extension 1000 can face the top surface 111 of the guardrail base 100. As also shown, the base extension 1000 can be configured to rotate with respect to the guardrail base 100 during removal or disengagement of the base extension 1000 from the guardrail base 100.

The guardrail system 80 and any component thereof such as, for example and without limitation, the guardrail base 100 and the base extension 1000 and any components thereof can be fabricated or otherwise formed from a metallic material such as, for example and without limitation, steel. The same components can be fabricated using any one or more of a variety of methods such as, for example and without limitation, laser cutting, stamping, three-dimensional printing, and bending. When welded, the components can be joined using any appropriate welding methods or other fastening methods or fasteners as desired.

A method for installing the guardrail system 80 can comprise placing the guardrail base 100 on the surface 51. The method can comprise inserting one or more of the posts 92*a,b,c* of the guardrail or guardrails 90 into the respective post bores 380*a,b,c* defined by the rail mount 120 of the guardrail base 100. The method can comprise tightening the rail mount 120 about the one or more posts 92*a,b,c* to positively fix an angle such as the angles 671,672 of the one or more posts 92*a,b,c* with respect to the guardrail base 100. The method can comprise positioning a second end 106 of the guardrail base 100 closer to the hazard to be avoided by the guardrail system 80.

The method step of tightening the rail mount 120 about the one or more posts 92*a,b,c* can comprise tightening the one or more fastening assemblies 390*a,b* extending from or through the fixed clamp body 320*a* to the floating clamp body 320*b* to reduce the offset distance 907 therebetween. The method step of tightening the rail mount 120 about the post 92*a,b,c* can comprise compressing a spring element 720 positioned between the fixed clamp body 320*a* and the floating clamp body 320*b*. The method step of inserting the post 92*a,b,c* of the guardrail 90 into the post bore 380*a,b,c* can comprise inserting the post 92*a,b,c* of the guardrail 90 into the post bore 380*a,b,c* with the fastening assemblies 390*a,b* tightened but with the spring element 720 in an uncompressed condition. The method step of tightening the rail mount 120 about the post 92*a,b,c* can comprise reducing the offset distance 907 defined between the fixed clamp body 320*a* and the floating clamp body 320*b*.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A guardrail base comprising:

a base body comprising a first foot, a second foot separate from and distal from the first foot, and a raised portion between the first foot and the second foot; and a rail mount comprising a fixed clamp body secured to the raised portion of the base body and a floating clamp body offset from and coupled to the fixed clamp body, the fixed clamp body intersecting the base body at an angle, walls of the fixed clamp body facing walls of the floating clamp body, the walls of the fixed clamp body and the floating clamp body configured to clamp an outside surface of a post of a guardrail.

2. The guardrail base of claim 1, wherein the fixed clamp body is secured to the base body with a weldment.

3. The guardrail base of claim 1, wherein the floating clamp body is coupled to the fixed clamp body with a fastening assembly.

4. The guardrail base of claim 3, wherein the fastening assembly comprises a spring element positioned between the fixed clamp body and the floating clamp body.

5. The guardrail base of claim 3, wherein the fastening assembly comprises a plurality of spring washers positioned between the fixed clamp body and the floating clamp body.

6. The guardrail base of claim 3, wherein the fastening assembly comprises a nut comprising a flange and received within a bore defined in the floating clamp body, the flange of the nut not able to pass through the bore.

7. The guardrail base of claim 3, wherein the fastening assembly comprises a nut coupled to the floating clamp body, an angular orientation of the nut fixed with respect to the floating clamp body.

8. The guardrail base of claim 1, wherein the rail mount defines a plurality of post bores in an assembled condition, each of the post bores configured to receive a post of the guardrail, the fixed clamp body and the floating clamp body together defining the plurality of bores.

9. The guardrail base of claim 1, wherein the rail mount defines a flared opening at a top end.

10. A guardrail system comprising the guardrail base of claim 1, wherein the system further comprises the guardrail, the guardrail received within a post bore defined by the rail mount of the guardrail base, the rail mount positively fixing an angle of the post of the guardrail with respect to the guardrail base.

11. A guardrail system comprising:

the guardrail base of claim 1, the guardrail base defining an effective support length of the guardrail system; and a base extension lockably engaged with the guardrail base and extending the effective support length, the effective support length defined by what combined portion of the guardrail base and the base extension rotate together upon any rotation of the guardrail base about an X-axis of the guardrail system, a lower surface of the base extension facing a portion of an upper surface of the guardrail base.

12. The system of claim 11, wherein the guardrail base defines a tab lockably engaged with the base extension.

13. The system of claim 12, wherein the tab is formed integrally with the base body of the guardrail base.

14. The system of claim 12, wherein the base extension defines an engagement opening sized to receive the tab of the guardrail base.

15. The system of claim 11, wherein the base extension defines a tab defining a width measuring less than an overall width of the base extension, the tab defining an engagement opening sized to receive a tab of the guardrail base.

16. A method for installing a guardrail system, the method comprising:

placing a guardrail base on a surface, the guardrail base comprising:

a base body; and a rail mount comprising a fixed clamp body secured to a raised portion of the base body and a floating clamp body coupled to the fixed clamp body, the fixed clamp body intersecting the base body at an angle, walls of the fixed clamp body facing walls of the floating clamp body;

inserting a post of a guardrail into a post bore defined by the rail mount of the guardrail base; and tightening the rail mount about the post to positively fix an angle of the post with respect to the guardrail base.

17. The method of claim 16, wherein tightening the rail mount about the post comprises tightening a fastening assembly extending from the fixed clamp body to the floating clamp body to reduce an offset distance therebetween.

18. The method of claim 16, wherein tightening the rail mount about the post comprises compressing a spring element positioned between the fixed clamp body and the floating clamp body.

19. The method of claim 16, wherein inserting the post of the guardrail into the post bore comprises inserting the post of the guardrail into the post bore with a fastening assembly tightened but with a spring element of the fastening assembly of the rail mount in an uncompressed condition.

20. The method of claim 16, further comprising engaging a base extension with the guardrail base to extend an effective support length of the guardrail system at the guardrail base.

21. The guardrail base of claim 8, wherein each of the fixed clamp body and the floating clamp body define an undulating shape defining the post bores.

* * * * *